US008695519B2

(12) United States Patent
Bearden

(10) Patent No.: US 8,695,519 B2
(45) Date of Patent: Apr. 15, 2014

(54) TUFTING MACHINE AND METHOD

(76) Inventor: John H. Bearden, Woodstock, GA (US)

( * ) Notice: Subject to any disclaimer, the term of this patent is extended or adjusted under 35 U.S.C. 154(b) by 96 days.

(21) Appl. No.: 13/412,599

(22) Filed: Mar. 5, 2012

(65) Prior Publication Data

US 2012/0222606 A1 Sep. 6, 2012

Related U.S. Application Data

(60) Provisional application No. 61/449,085, filed on Mar. 3, 2011.

(51) Int. Cl.
*D05C 15/14* (2006.01)
*D05B 27/10* (2006.01)

(52) U.S. Cl.
USPC ..... 112/475.23

(58) Field of Classification Search
USPC ..... 112/63, 102, 102.5, 475.01, 475.17, 112/475.04, 475.07, 475.08, 475.23, 112/470.13, 470.17, 103, 304, 306
See application file for complete search history.

(56) References Cited

U.S. PATENT DOCUMENTS

| | | | | | |
|---|---|---|---|---|---|
| 1,661,023 | A * | 2/1928 | Turner et al. | ..... | 112/63 |
| 1,937,491 | A * | 11/1933 | May | ..... | 112/117 |
| 2,546,527 | A * | 3/1951 | Smyth | ..... | 112/306 |
| 3,819,465 | A * | 6/1974 | Parsons et al. | ..... | 428/176 |
| 3,865,059 | A * | 2/1975 | Jackson | ..... | 112/80.32 |
| 5,022,336 | A * | 6/1991 | Iwase | ..... | 112/304 |
| 6,720,058 | B1 * | 4/2004 | Weeks et al. | ..... | 428/94 |

* cited by examiner

*Primary Examiner* — Ismael Izaguirre
(74) *Attorney, Agent, or Firm* — Invention Protection Associates, LLC

(57) ABSTRACT

A method for using a tufting machine to produce athletic turf bearing precise graphic tuft patterns at a high throughput rate is disclosed. The utilized machine includes tenter frame and a series of tufting frames upon which tufting head components are mounted. The entire length of a piece of backing material is wrapped around the tenter frame, and the tenter frame circulates the backing past the tufting frames, and the tufting head components are shifted as may be necessary to form a desired graphic tuft pattern.

3 Claims, 10 Drawing Sheets

TUFTING MACHINE AND METHOD

This non-provisional application claims the benefit of provisional application No. 61/449,085 filed Mar. 3, 2011.

BACKGROUND

Conventional broadloom tufting machines designed for manufacturing carpet and artificial athletic turf in high volume are primarily characterized by having cooperating backing feed and tufting head assemblies. Typically, such backing feed assemblies are defined by an arrangement of feed and take-up rollers that convey an elongate sheet of backing fabric longitudinally through a tufting zone area in which yarn is inserted into the steppedly advancing backing. Differential rotation between feed assembly rollers stationed at opposing ends of the tufting zone creates longitudinal tension in the backing.

The tufting head portion of the typical broadloom machine generally features one or more elongate bars of yarn-delivering needles which are disposed above the horizontally oriented backing and aligned transverse to the direction of its movement, as well as an equivalent number of yarn-catching loopers that are disposed below the backing. Needles along the needle bar(s) each receive yarn, delivered by any of a variety of suitable yarn feed mechanisms, from a designated spool situated within a yarn creel. So, as the backing sheet travels past the tufting head, needle bars are continually reciprocated downward so that the needles along them penetrate and insert yarn into the backing in unison. The loopers operate in synchronicity with the needles such that, as each needle momentarily protrudes the backing, a corresponding looper catches its yarn before the needle returns upward. This repeated interaction produces "loop pile" tufts of yarn along the backing. Additionally, knives can be used to sever just-formed loops and thereby render "cut pile" tufts.

Where uniformly patterned carpet or vast monochrome sections of athletic turf are to be produced in high volume, a broadloom tufting machine's needle can span the entire transverse width of the backing material. The incremental, longitudinal progression of the backing material that immediately follows each stroke of the needle bar causes the laterally-aligned needles to form every longitudinal running row of tufts intended to be created across the lateral length of the backing sheet. Thus, the tufting needles stationed along the needle bar remain at constant lateral positions, and there is no need for them to be transversely shifted when creating carpet or turf sections having uniform tuft placement and yarn color. On the other hand, tufting machines exhibiting constant axis needle bar movement are generally not suitable for producing multicolored articles of tufted material. So, the prior art has seen tufting machines improved to enable their needle bars to shift laterally, relative to the backing, in order that the particular type of yarn delivered by particular individual needles be selectively inserted into the backing at specific tuft locations in accordance with a preconceived pattern. For example, U.S. Pat. No. 4,829,917 to Morgante, et al. discloses the use of a computer-controlled hydraulic actuator for shifting a needle bar into different lateral positions in response to preselected stitch pattern information stored in the computer. As another example, U.S. Pat. No. 5,979,344 to Christman, Jr. discloses the use of computer-controlled inverse roller screw actuators for shifting needle bars laterally, as well as for shifting the backing sheet itself laterally, in order to tuft a graphic pattern of yarn into the backing as it advances longitudinally past transversely aligned needles.

Nevertheless, even with the lateral shiftability of their tufting heads, these prior tufting machines employing backing feed mechanisms are still not optimum for producing dynamic, multicolored tuft patterns like those often found in logo-bearing sections of athletic turf fields. The synchronous reciprocation of their bar-mounted needles is capable of producing only linear color patterns, and even lateral shifting of the needle bars can no more than produce diagonal or zigzagging patterns. Furthermore, since conventional tufting machines with backing feed mechanisms experience many subtle operational irregularities in the cooperative motions of their tufting head and backing feed components, the tuft patterns that they create tend to be somewhat imprecise. More specifically, tufting needles of prior art fed backing-type tufting machines reciprocate (along Z-axes) and may shift (along an X-axis) in timed relationship with the backing fabric's stepped longitudinal progression (along a Y-axis) past those needles, and whenever that three-axis motion relationship is altered in an unplanned way, the tufting needles fail to insert yarn tufts precisely at intended positions. For example, any sudden tag or surge in the feed mechanism's operation can create irregularity in the longitudinal spacing between successive tufts within rows, and any lateral skewing of the backing sheet can displace tuft rows entirely. The result of either occurrence may be noticeable distortion of the overall graphic image being created.

In addition, inherent characteristics of backing material itself tend to undermine the quality of the graphic output of these prior art machines. To wit, because backing sheets are typically fabricated of coarsely woven material, they are susceptible to being non-uniformly stretched in either direction as feed rollers advance them through a tufting zone. Since athletic field logos, for example, are almost always too large to be entirely formed within the lateral boundaries of a single machine's tufting zone—which is typically not more than feet wide—they must be created in pieces by individually tufting separate sheets of backing material and then gluing those sheets contiguously onto a base layer material. This leaves open the possibility that one image-bearing section of backing will progress through the tufting zone differently, in some respect, than does another section that will be adjacently laid section and will, thus, create visible color discontinuity within the installed composite image. Therefore, in the process of tufting separate graphically patterned artificial turf pieces for a single installation, it is important to ensure that tension applied to backing material remains consistent and that no unwanted lateral or irregular longitudinal movement of backing material occurs within the tufting zone.

Tufting head assemblies in which the tufting needles move two-directionally relative to a statically held backing sheet have been developed in the prior art to address these stability concerns related to production of dynamic tuft patterns. For example, U.S. Pat. No. 5,743,200 to Miller, et al. discloses a tufting machine that employs a gantry-like component which is movable along a Y-axis and which carries a tufting head that is movable along an X-axis. The Miller tufting head is disposed above the backing material, and it is mounted to the gantry via its attachment to a frame which is gearably connected to and movable along the gantry. The tufting head generally comprises a cylinder that is slidably secured to the frame, a piston that reciprocates within the cylinder, a needle that is secured to the bottom end of the cylinder and a blade that is positioned within the needle and is secured to the bottom of the piston. The blade projects from and retracts into the needle to assist the needle in protruding down through the backing to form loop pile tufts therein. The Miller tufting machine also includes a second, lower gantry that spans transversely below the backing material and moves along a Y-axis in synchronicity with the upper gantry. This lower gantry provides underlying support for the backing material in order to limit the downward deflection that would otherwise result from the pressure applied by the blade and needle operating on the backing.

Another example is found in U.S. Pat. No. 7,814,850 to the present inventor, John Bearden. That patent discloses a tufting machine with a dual-beam gantry configuration and that includes a computer-controlled tufting head adapted to move along X and Y axes in order to insert various yarns at precise locations along a clamped down and statically held backing in accordance with a design pattern which is stored in the computer. It also discloses a tufting head for producing precise graphic tuft patterns that is defined by having two distinct and asynchronously driven parts: (a) a needle carriage that is movably mounted along the upper gantry beam (i.e., above the backing) and features a number of separately operating tufting needles that are selectively reciprocated to insert tufts as the carriage journeys along an X-axis; and (b) a looper carriage that is movably mounted to the lower beam (i.e., below the backing) and is not mechanically connected to the needle carriage, but rather is selectively advanced to and fro along that beam in non-unison with the needle carriage such that a single looper and cutter pair may selectively cooperate with each one of multiple carriage needles as they individually downstroke.

Nevertheless, while tufting head mobility allows backing sheets to be stably fixed in place while being operated upon and, thus, allows the tensions applied to workpiece backing sheets to be repeatedly replicated, prior art fixed backing-type tufting machines tend to have lower production throughput than do their fed backing counterparts for a couple of specific reasons. First, with fixed backing-type machines, between successive iterations of clamped backings being manually swapped out by human operators, tufting is performed on individual backing pieces whose dimensions are limited to the generally rectangular dimensions of the machines' tufting zones. Because of those limitations, if a single fixed backing-type machine of the prior art is being used to tuft and entire athletic field, the required manual interludes add an amount of time to the tufting process that is directly proportionate to the ratio of the total size of the tufted field to the size of the machine's tufting zone. In other words, the greater the quantity of separate backing sheets that must be successively tufted due to dimensional limitations of the fixed backing machine's tufting zone, the more process-slowing manual intervention will necessarily be involved in the start-to-finish process of tufting the field.

In some instances, this dynamic has led to athletic turf manufacturers having to invest in multiple units of similar or identical tufting machines and the manufacturing facility space needed to accommodate all of them in order to meet production demands. In other instances, it has led to athletic field purchasers obtaining the multiple tufted backing sections that are to form a single field installation from separate vendors: one vendor which is better suited for high throughput production of vast, more monochromatic sections of the field (e.g., green areas) and another vendor which is better equipped to produce smaller, more color diverse image sections in higher quality. Moreover, aside from any manufacturing inefficiencies, the more discrete backing pieces that are to be part of a field installation, the more laborious the installation process becomes, as installers must meticulously lay the distinct pieces side-by-side atop a base surface, rather than being able to simply unroll a continuous sheet of backing that covers an equal-sized area. So, especially where graphic pattern tufting is involved, it is a constant production goal to minimize the quantity of distinct articles of tufted backing that are to comprise a single turf installation.

Accordingly, the present invention significantly contributes toward that goal by introducing a method for using a tufting machine in order to produce sections of graphically tufted turf under conditions of backing stability achieved by prior art fixed backing-type machines, but that, without manual intervention, allows for continuous tufting of a backing section of more than twice the length of that which could be by prior fixed backing-type machines of equivalent tufting zone length and occupying the same amount of floor space.

SUMMARY

The present invention generally relates to tufting machines and methods for use thereof, and it specifically relates to a method of using a tufting machine, which is principally intended for producing artificial athletic turf and includes a tenter frame, so as to circulate in some instances, bidirectionally—an elongate sheet of backing material through a longitudinal series of rows of laterally arranged, selectively reciprocated tufting needles. In fact, the primary objective of the invention is to enable a tufting machine to perform, without any intervention or interruption by a human operator, high-precision, graphic image tufting on an article of backing material of greater than twice the size that could be done so by prior art tufting machines configured to maintain backing under similar conditions of tension and lateral stability—namely, fixed backing-type tufting machines and having equal-sized tufting zones. In so doing, the present invention allows a manufacturer of precise graphic image-bearing turf to more than double its production output from within the same amount of equipment floor space.

In one aspect, the apparatus of the present invention neither uses powered rollers to pass backing material through a tufting zone in a potentially laterally unstable manner nor requires that a backing sheet be clamped down and fixedly held in uniform tension while being tufted. Rather, the present apparatus employs a tenter frame, defined by a parallel pair of endless tenter chains, to engage the lateral near edges of a backing strip and pass it through the tufting zone with complete lateral stability and appropriate lateral tension.

In another aspect of the invention, prior to initiating the tufting process, a backing strip is to be wrapped around the tenter frame such that the full length of the strip is engaged by pins mounted along both tenter chains. Consequently, as the endless chains rotate, the backing circulates through the tufting zone. For maximum throughput, the attached backing strip will measure the length of a tenter chain and, thus, will fully envelop the tenter frame. This is more than twice the length of backing material that could be tufted by a typical fixed backing-type machine that has the same tufting zone length, and depending on the configuration of the tenter frame depending upon whether it has vertical reaches at its longitudinal ends), an apparatus of the present invention could operate on a backing of considerably greater length than could its prior art counterparts which occupy the same amount of floor space.

In another aspect, the apparatus features multiple, dual beam tufting gantries that are fixed at equally spaced positions along the length of its tufting zone—which constitutes most of the upper reach of the tenter frame. Laterally spaced along each gantry's upper beam are laterally shiftable and individually reciprocating tufting needles, and a corresponding set of laterally shiftable loopers are mounted along its lower beam. Although, within the scope of the invention, the exact number of tufting gantries employed can vary, that count may directly correlate to the number of distinct yarns to be tufted. For example, each yarn can be assigned to a different gantry and delivered to all of the needles therealong that will be utilized, at some point, during the tufting of an attached backing strip.

DESCRIPTION OF THE PREFERRED EMBODIMENTS

Figure 1:
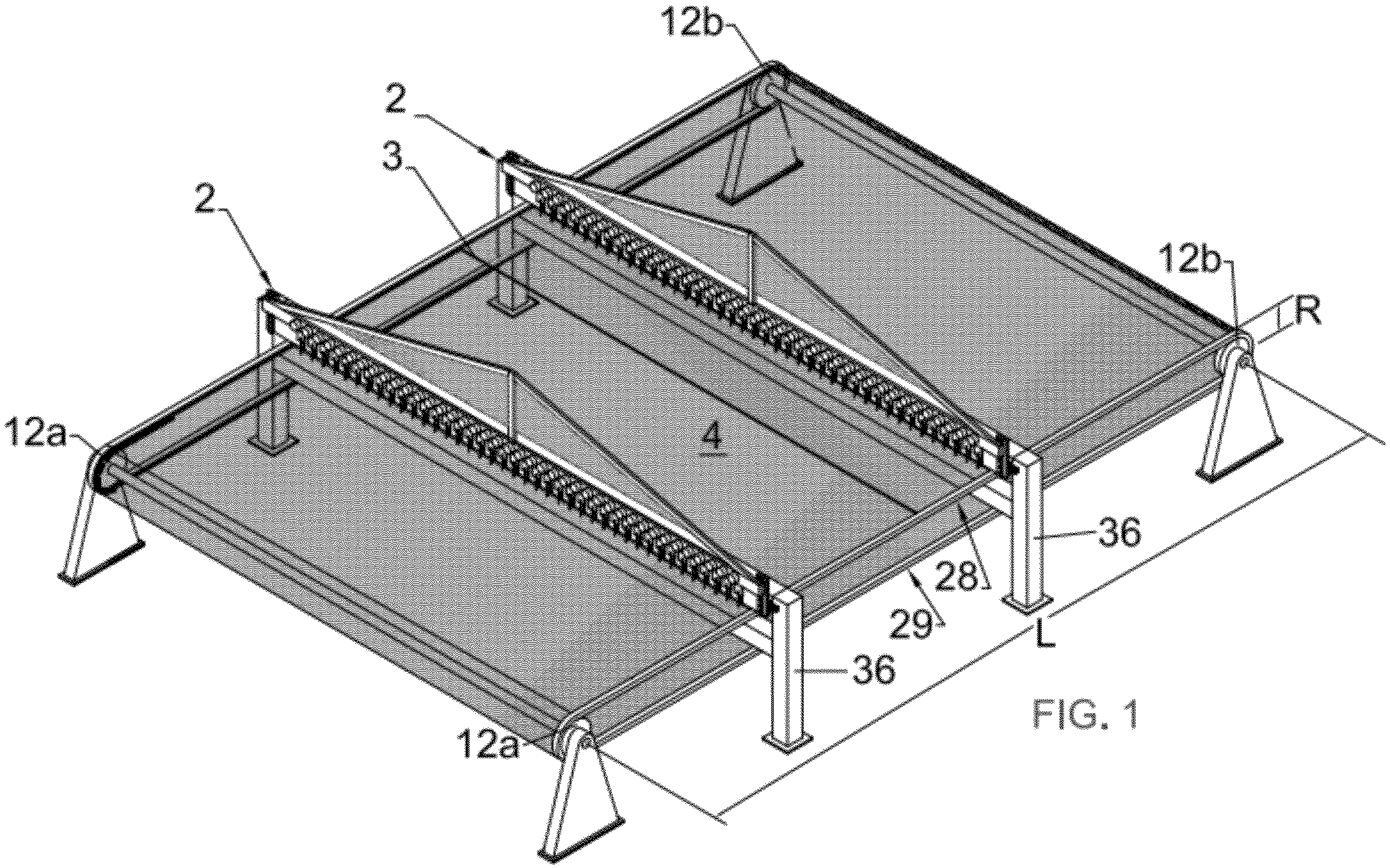
FIG. 1 is a perspective view of a two-tufting frame version of an embodiment of tufting machine of the present invention, shown with a sheet of backing material fully wrapped around the machine's tenter frame.

It should be understood that the present disclosure has particular applicability to machines used for manufacturing athletic turf and other cut pile articles bearing graphic designs, but it can be applicable to tufting machines generally. The apparatus aspects of this disclosure are embodied in FIGS. 1-3 and 10, and they relate to a tufting machine apparatus comprising two primary structural elements: a tenter frame 5 and at least one tufting frame 2. The machines depicted in FIGS. 1 and 10 consist of two such tufting frames 2, and either of those embodiments of the present apparatus can be used to perform the tufting method of the present invention, as will be described in more detail later below. Nevertheless, ensuing descriptions of the present apparatus should be presumed applicable to the apparatus embodiment shown in FIG. 1, unless explicitly noted otherwise. As sub-elements of the tenter frame 5 are endless chains 13 that each have a multitude of pin pads 11 attached therealong, and as sub-elements of the each tufting frame 2 is a "tufting head" which, itself, comprises a needle carriage assembly 20 and looper carriage assembly (not shown). Additionally, a computer (not shown) is used to control motions imparted by the respective drive components of the tenter frame 5, needle carriages 20 and individual needles 14 of the tufting apparatus throughout its operation.

Figure 3:
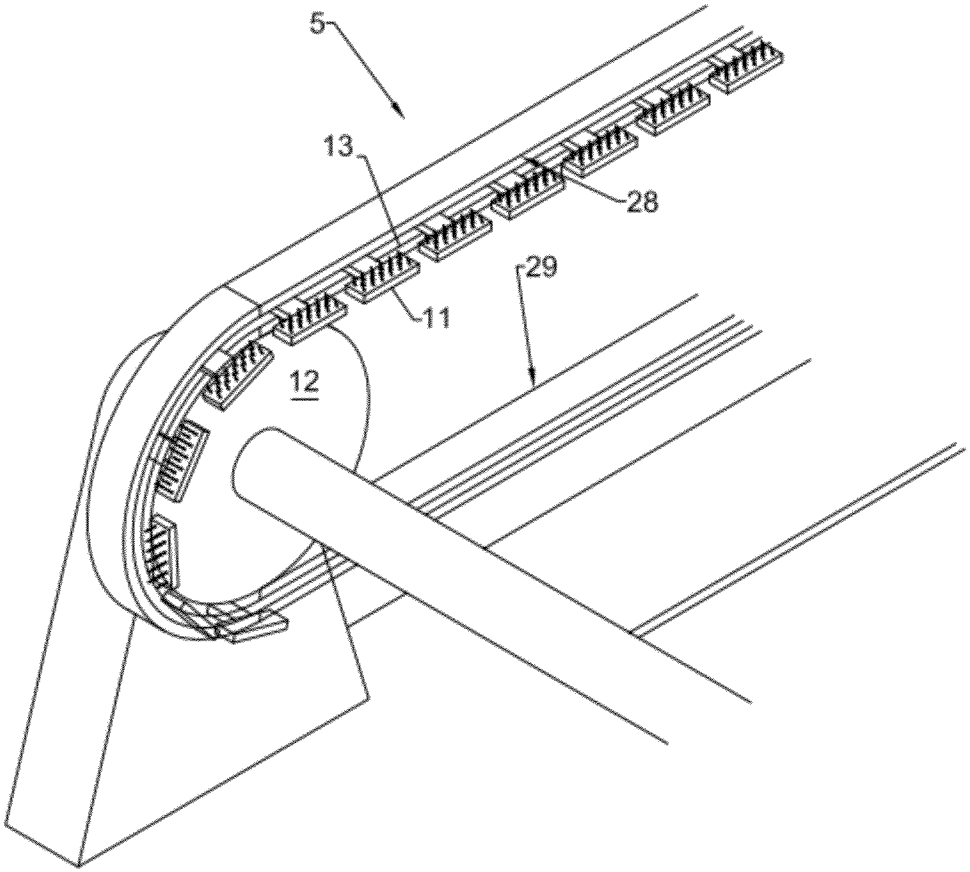
FIG. 3 is a perspective view showing an end portion of said tenter frame.
Figure 10:
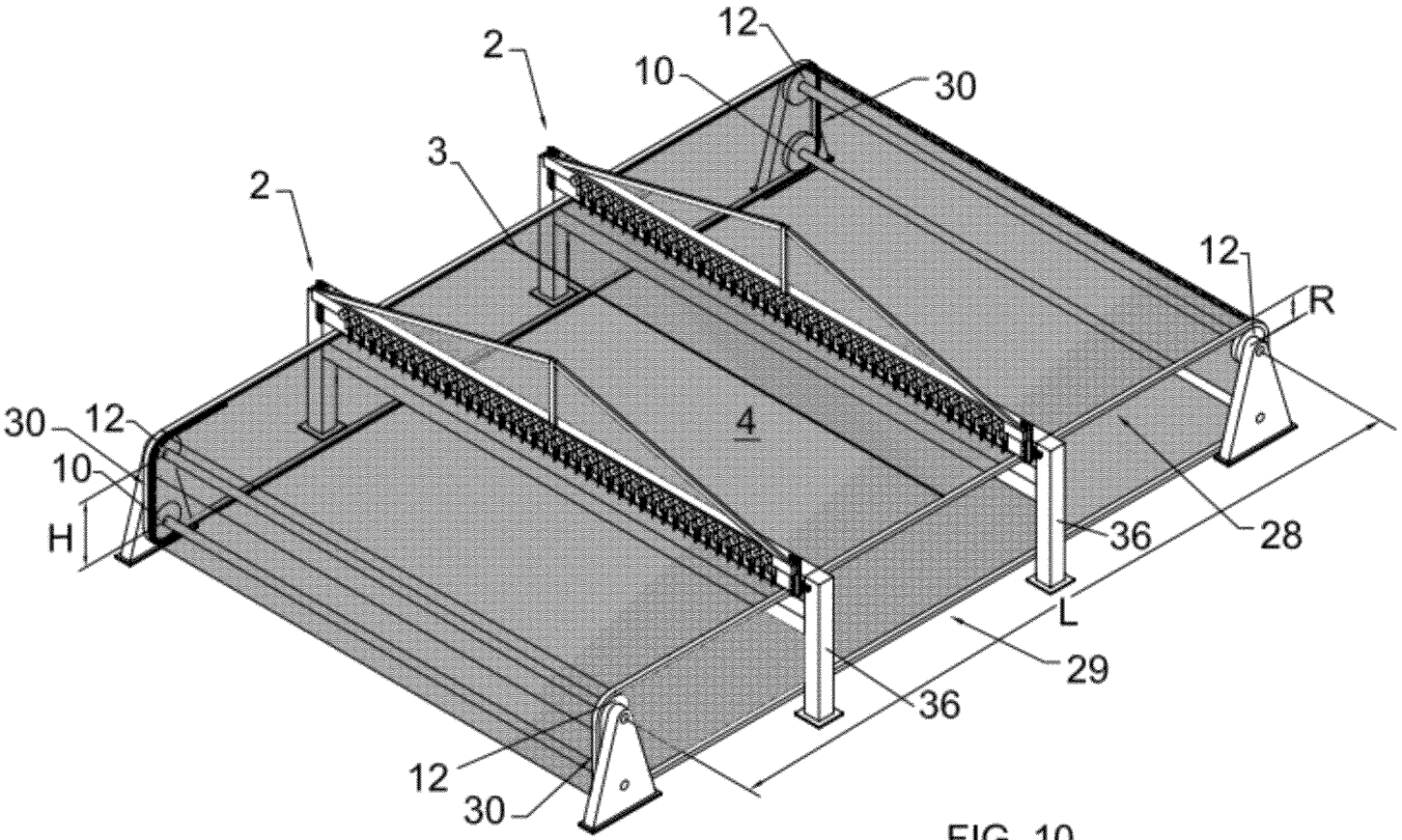
FIG. 10 is a perspective view of a two-tufting frame version of another embodiment of tufting machine of the present invention, shown with a sheet of backing material fully wrapped around the machine's tenter frame.

A partial, end portion of an embodiment of the tenter frame 5 is shown in isolation in FIG. 3. The tenter frame 5 generally comprises a parallel pair of endless chains 13 which are each looped around shaft-driven sprockets 12. In the embodiment of tenter frame 5 depicted in FIGS. 1 and 3, the chains 13 are each looped around two sprockets 12 to create upper and lower reaches 28, 29 of the tenter frame 5. However, as is shown in FIG. 10, additional sprockets 10 disposed below the aforementioned ones 12 can be employed to form vertical reaches 30 at the longitudinal ends of the tenter frame 5. This gives the tenter frame 5 a height dimension H that enables an even longer backing to be loaded onto and circulated by the apparatus and represents an even more efficient use of the machine-occupied floor space. Finally, pin pads 11 mounted along the entire lengths of the tenter chains 13 are able to grip an elongate sheet of backing material 4 near its lateral edges and allow the tenter frame 5 to advance sections of the backing 4, relative to the tufting frames 2, via chain rotation. This engagement also effectively prevents lateral displacement of the backing 4 as it is circulated by the tenter frame 5 during the tufting process. A typical backing sheet 4 to be tufted by the present apparatus will have a width approximately equal to the lateral distance between the parallel tenter chains 13 (e.g., fifteen feet).

Figure 2:
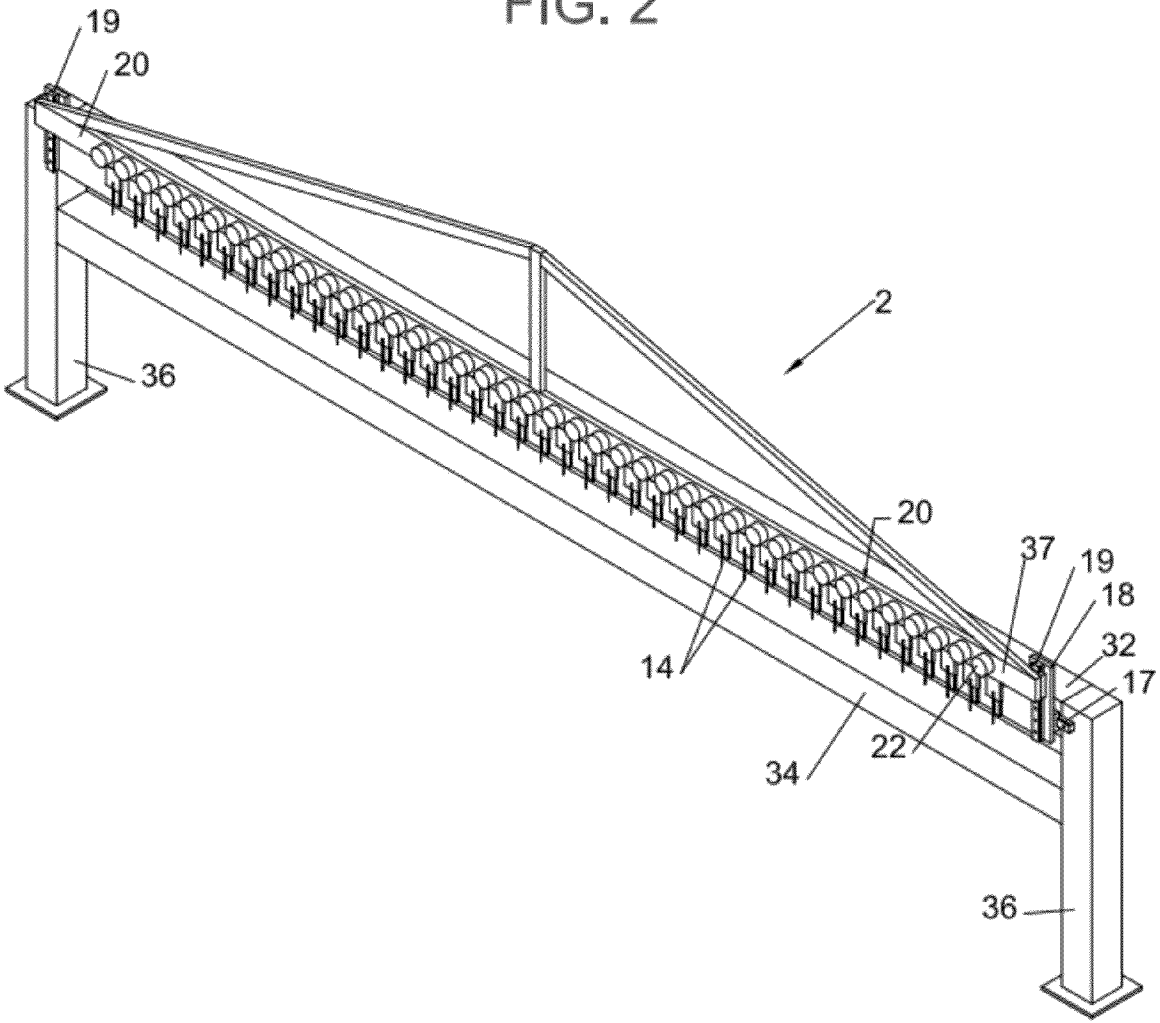
FIG. 2 is a perspective view of a tufting frame element and needle beam assembly of said machine.

Within the scope of the invention, the apparatus can include and utilize as few as one tufting frame 2 during its operation. Nevertheless, it will optimally utilize at least as many tufting frames 2 as is the number of distinct yarns (e.g., different colors) to be tufted into a backing 4 in executing a single tufting program. For example, if a roll of backing 4 is to be tufted into football field turf with green yarn, predominantly, as well as much smaller volumes of white, red and blue yarns, then operational efficiency may dictate dedicating one tufting frame 2 to each of the white, red and blue yarns and at least two tufting frames 2 to the green yarn. In any event, a tufting, frame 2 is a gantry-like structure defined by dual horizontal beams 32, 34. As seen in FIG. 1, these beams 32, 34 traverse above and below the backing 4, respectively, and they are elevated from the floor by vertical posts 36 attached at their outer ends. The "tufting head" portion of the apparatus is actually formed by two yarn manipulating carriages which are slidably mounted to the separate tufting frame beams 32, 34. More specifically, and as can be seen in FIG. 2, running along the front face of the upper beam 32 is a rail 17 to which an elongate needle carriage 20 is slidably mounted. Although not illustrated, a similar rail-mounted looper carriage is disposed along the lower beam 34. Computer-controlled drive systems allow these carriages to synchronously travel laterally along the tufting frame 2.

Finally, the needle carriage 20 introduces yarns (not shown) into the backing 4. The needle carriage 20 can have virtually any configuration so long as it includes means for reciprocating individual yarn needles and its travel along the upper beam 32 is computer-controlled. Nevertheless, in the embodiment depicted in FIG. 2, the needle carriage 20 includes a parallel pair of vertically disposed base plates 18 to which a needle bar 37 is coupled. In fact, the needle bar 37 is vertically slidable along rails 19 attached to the fronts of the base plates 18, and it is laterally driven along the upper beam 32 of the tufting frame 2 by mechanisms disclosed in U.S. Pat. No. 7,814,850 to the present inventor (the '850 patent). A series of tufting needles 14 are aligned along the needle bar 37 via individual needle drive mechanisms which asynchronously reciprocate the needles 14. The needles 14 can be driven by a variety of means known in the art. While needles 14 insert their yarns into the backing 4 in accordance with a predefined pattern, corresponding loopers hook those yarns to form loop pile tufts along the downward facing side of the backing 4. Then, to form cut pile, a cutting mechanism of the type also disclosed in the '850 patent is utilized.

The method aspects of this disclosure, which can be discerned from viewing FIGS. 1 and 4-9, relate to a heretofore unseen manner of using the tenter frame 5 in order to facilitate tufting action. More specifically, rather than using the upper reach 28 of the tenter frame 5 as a linear conveyor of backing material, the frame 5 is used to circulate an article of backing 4 past tufting heads as many times as is necessary to complete its tufting. Therefore, in preparation for tufting, an elongate sheet of backing material 4 is loaded onto the aforedescribed tufting apparatus by way of wrapping it around the tenter frame 5.

In the preferred manner reflected in FIG. 1, the loaded backing 4 has a length approximately equal to $2\times(\Pi\times R+L)$, where L is the distance between the respective axes of the tenter frame's proximal and distal drive sprockets 12*ab*, and R is the radius of a sprocket 12. At that length, the backing strip 4 fully encircles the tenter frame 5 with its opposing ends 3 exactly meeting. In fact, those ends 3 can be joined by temporary fasteners (not shown) in order to ensure that the backing 4 holds securely onto the tower reach 29 of the tenter frame 5 during tufting, if necessary. However, the present inventor has observed that backing fabric 4 of the type typically used in artificial athletic turf applications tends to engage the pin pads 11 with enough friction to prevent gravity from causing its inverted portion along the lower reach 29 from detaching even without such aid.

To initiate loading, one end 3 of the backing 4 should be manually pressed onto the particular pin pads 11 which happen to be positioned directly atop laterally opposing drive sprockets 12 disposed at one end of the frame 5. Then, the tenter chains 13 should be set into motion, causing the lead end 3 of the backing 4 to convey toward, and eventually around, the drive sprockets 12*b* at the opposite (distal) end of the tenter frame 5 until the entire backing 4 is wrapped around the tenter frame 5. During initial loading, it may be desirable to employ a guide mechanism (not shown) for keeping the backing 4 impaled onto pin pads 11 as the leading edge 3 arrives directly the distal sprockets 121) where the engaging pads 11 begin arching downward and, later, as the leading edge 3 arrives directly below the proximal sprockets 12*a* where the pads 11 start returning upward. For example, a series of roller brushes (not shown) whose soft bristles impinge against pin pads 11 as they turn about the ends of the tenter frame 5 could be used.

After the full length of the backing sheet 4 is wrappingly secured to the tenter frame 5, the tufting heads should be properly positioned to begin the process of tufting a computer-stored design. However, "proper" positioning is dictated by a multitude of factors related to the configuration of the present machine (e.g., tufting frame count and lateral spacing of needles) as well as the particular graphic design to be tufted (e.g., desired tuft gauge, number of distinct yarns used and pattern placements thereof). For example, if it were the case that no two distinct yarns are to be tufted into any to-be-formed tuft row, needle carriages 20 along the existent number of tufting frames 2 could be laterally offset relative to each other so that a tufting needle 14 is positioned to form every planned tuft row during a continuous, single revolution of the backing 4 through the tufting zone. However, since the present machine will typically be used to tuft more dynamic patterns and because the desired tuft gauge, needle spacing and tufting frame count will often be such that the backing 4 will need to revolve around the tenter frame 5 and pass each tufting frame 2 multiple times, with backing progression occasionally pausing to allow one or more needle carriages 20 to lateral shift, so that new longitudinal tuft rows may be created and different colored yarns can be tufted within single rows throughout the course of multiple backing revolutions. It should be understood that, within the scope of the invention, the present tufting machine can exist in a variety of embodiments with regard to both the number of tufting frames 2 it employs and the tuft placement and/or color assignments delegated to needles 14 along each frame 2.

When utilizing the two-tufting frame apparatus illustrated in FIG. 1, the tufting heads are property positioned by both needle carriages 20—along which tufting needles 14 span transverse the direction of the backing 4 (see FIG. 2)—being at their furthest right or left lateral position. Each carriage 20 is laterally movable by virtue of its connection to a pair of base plates 18 which are slidably attached a horizontal rail 17 along the upper beam 32 of the corresponding tufting frame 2. A carriage 20 is also vertically positionable by virtue of its slidable attachment to vertical rails 19 disposed along the respective faces of those base plates 18. Therefore, the carriage 20 should also be preset to form a particular height of tufted pile along the backing 4. Then, to begin tufting, the tenter frame sprockets 12 are set into stepped rotation by their drive motors (not shown). This, of course advances both tenter chains 13, and the backing sheet 4 secured to them begins its first revolution around the tenter frame 5.

The incremental backing movements are made in coordination with the downstroking of tufting needles 14 in order to produce longitudinal tuft patterns along the backing 4. Furthermore, each of the needles 14 is individually controlled and is selectively reciprocated to generate the computer-stored graphic design. More specifically, needle selection solenoids 22 are energized for each corresponding tufting needle 14 that is positioned over a tuft location where the color of yarn then being carried by those needles 14 is to be inserted into the backing 4 in accordance with the preconceived design. Again, proper vertical placements of the needle carriages 20 above the plane of the backing 4 cause the eye of each reciprocated needle 14 to pierce through the backing 4 to a depth of the desired synthetic grass height. The yarn bundle carried by a reciprocated needle 14 is then engaged by looper and cutter mechanisms (not shown) mounted to the lower beam 34 of the corresponding tufting frame 2 which cooperate with the needles 14 to form cut pile tufts on the downward facing surface of the backing sheet 4 in well-known fashion. This alternating succession of needle strokes and backing movements continues until the backing 4 has completed a full revolution around the tenter frame 5, with every segment of the backing 4 having made one pass of both tufting frames 2.

Figure 4:
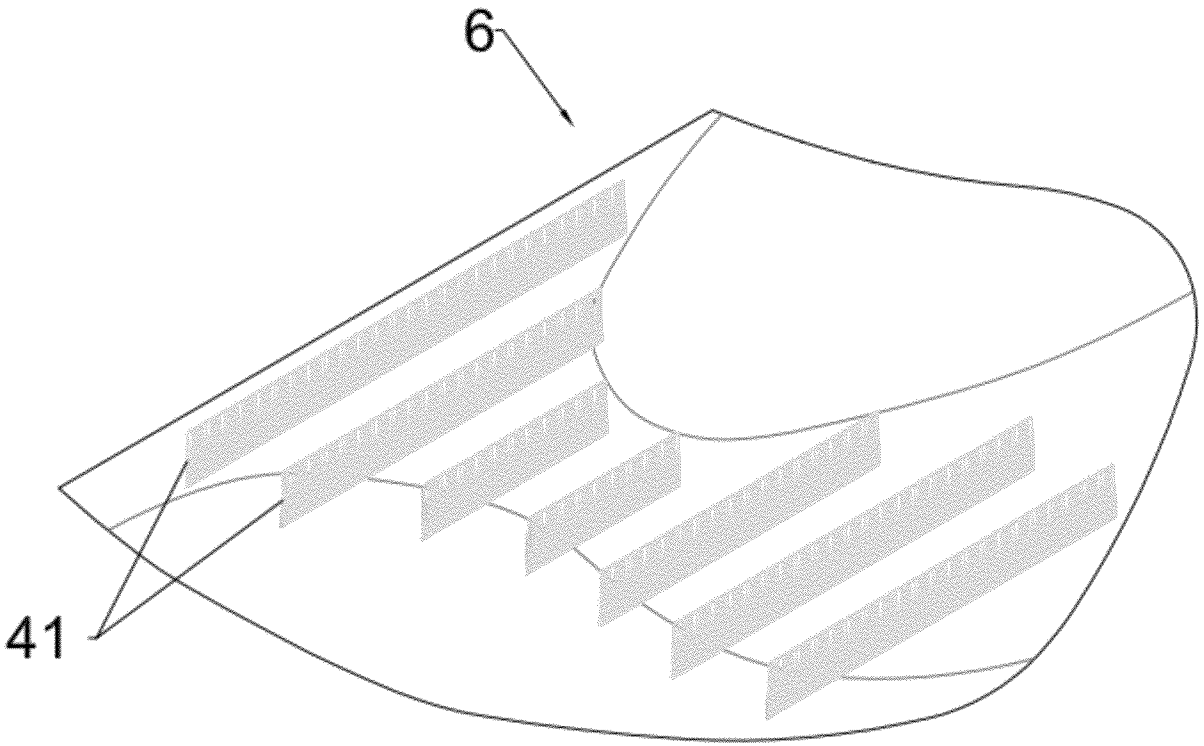
FIG. 4 is a perspective view showing a segment of a sheet of backing material after having undergone a first pass of the first encountered tufting frame of said machine.
Figure 5:
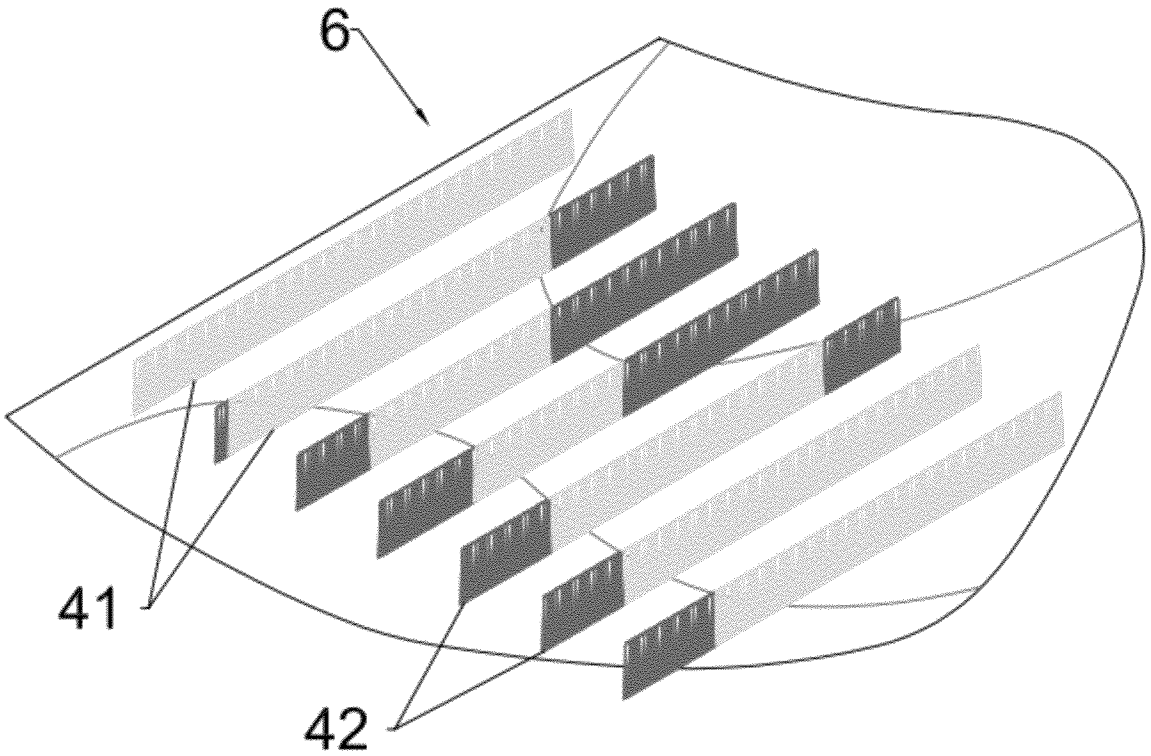
FIG. 5 is a perspective view showing said segment of backing material after having subsequently undergone a first pass of the second encountered tufting frame of said machine.

FIGS. 4 & 5 illustrate an example of sequential formation of tuft pattern along a short segment 6 of the backing 4 which occurs during a first such pass of the two-gantry apparatus of FIG. 1. Specifically, FIG. 4 shows how a first, light-colored yarn 41 is tufted within a first set of longitudinal rows by the needles 14 along the first tufting frame 2 that the section 6 encounters during its first pass through the tufting zone. FIG. 5 shows how a second, dark-colored yarn 42 is subsequently tufted within that same set of rows by the next tufting frame 2. In this example, all operating needles 14 of the first tufting frame 2 deliver the first yarn 41, and all operating needles of the second frame 2 tuft the second yarn 42. After the section 6 of backing 4 passes both tufting frames 2 while traveling in a direction along the upper reach 28 of the tenter frame 5, it becomes inverted and returns in the opposite direction along the lower reach 29 so that it may pass through the tufting zone again.

Figure 6:
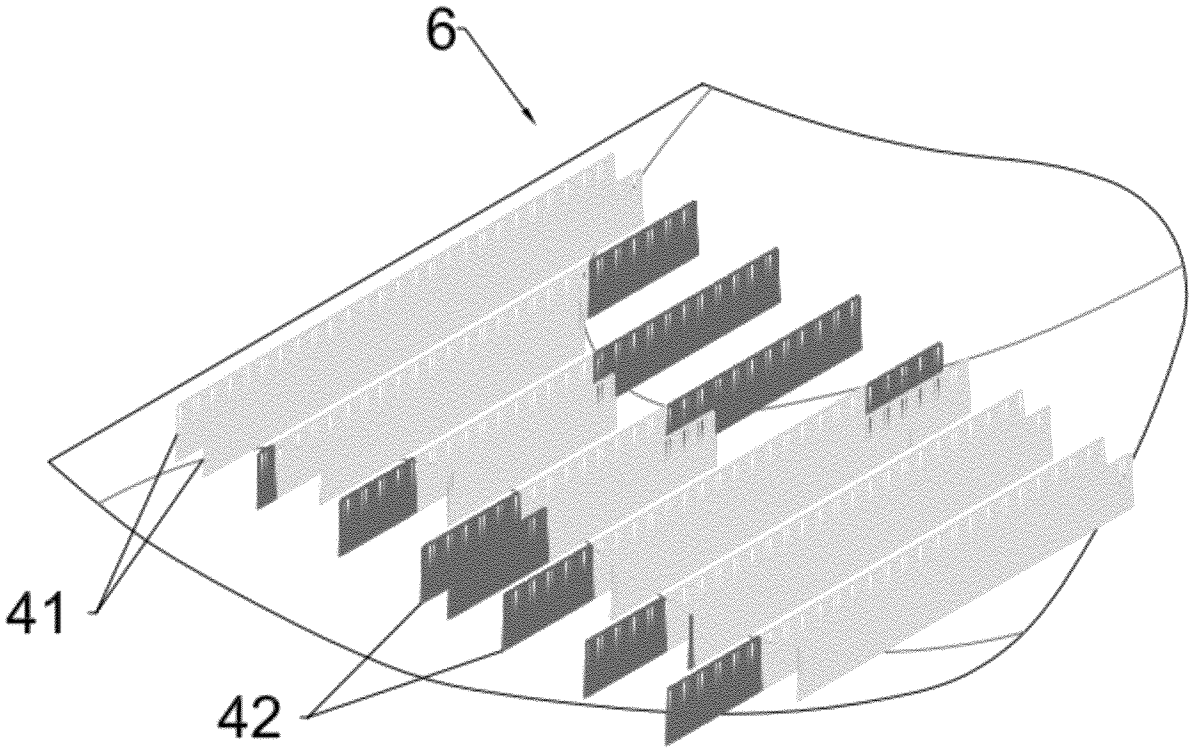
FIG. 6 is a perspective view showing said segment after having subsequently undergone a second pass of said first tufting frame after the tufting needles mounted therealong were laterally displaced a distance equal to a desired tufting gauge.
Figure 7:
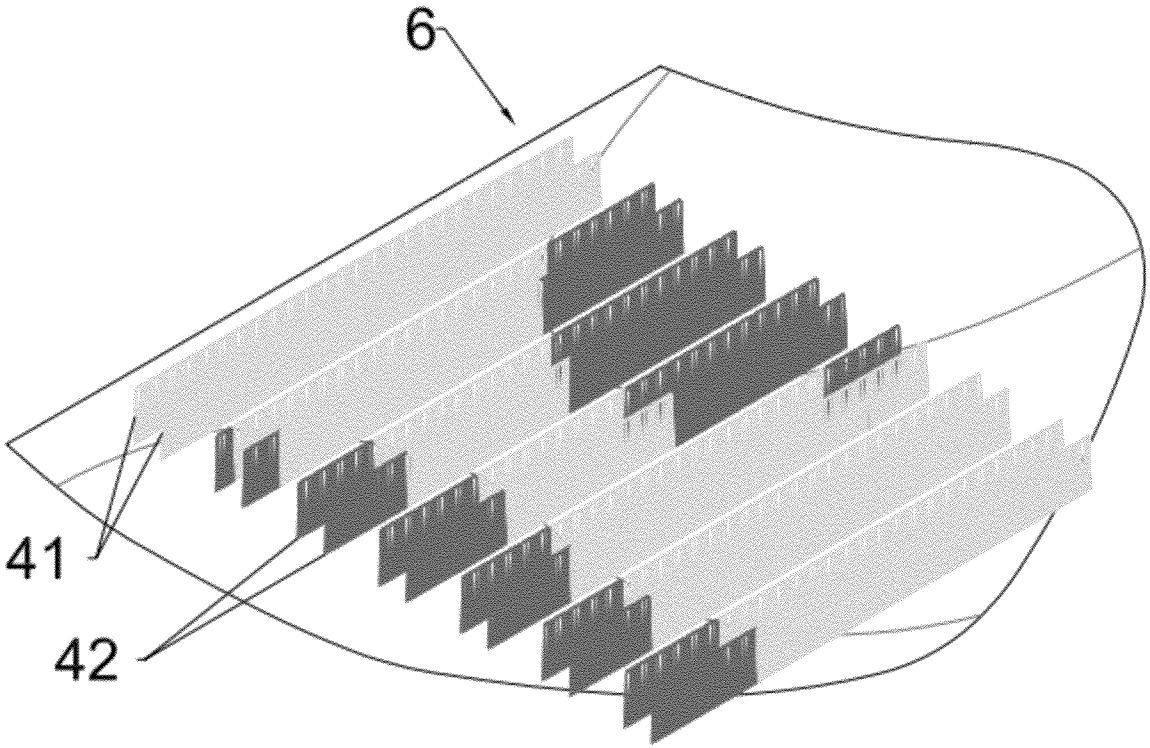
FIG. 7 is a perspective view showing said segment after having subsequently undergone a second pass of said second tufting frame.
Figure 8:
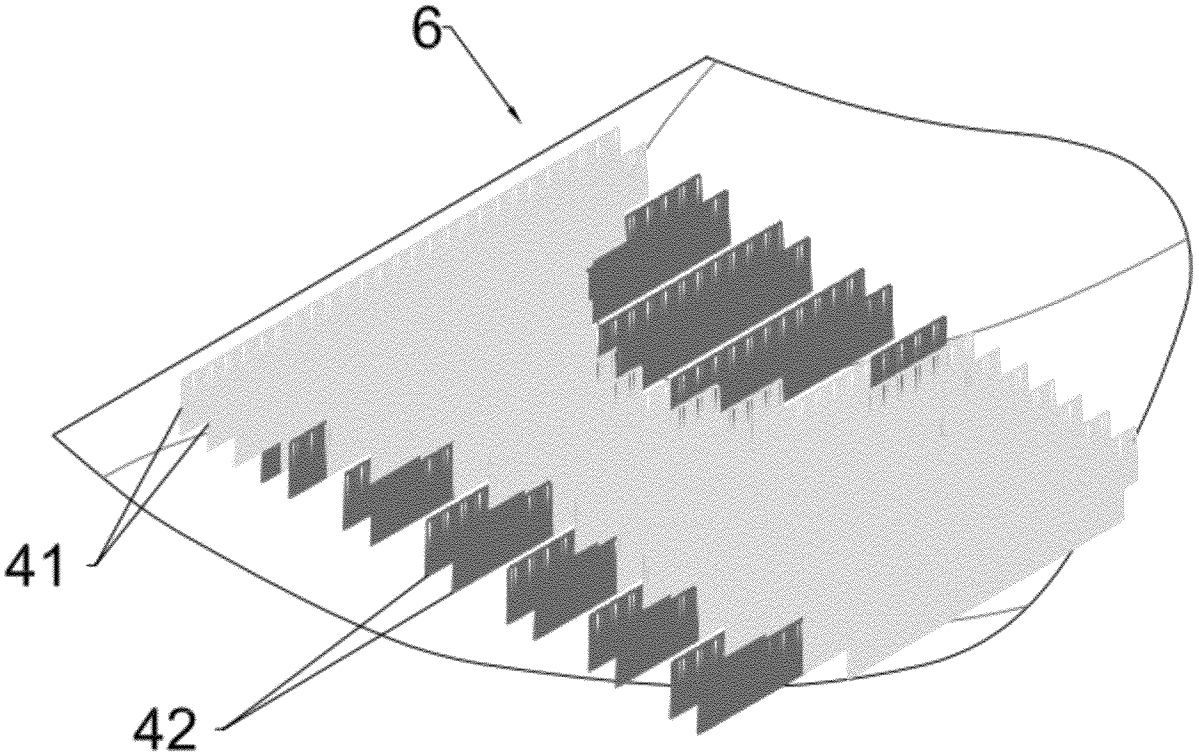
FIG. 8 is a perspective view showing said segment after having subsequently undergone a third pass of said first tufting frame after the tufting needles mounted therealong were, again, laterally displaced a distance equal to said tufting gauge.
Figure 9:
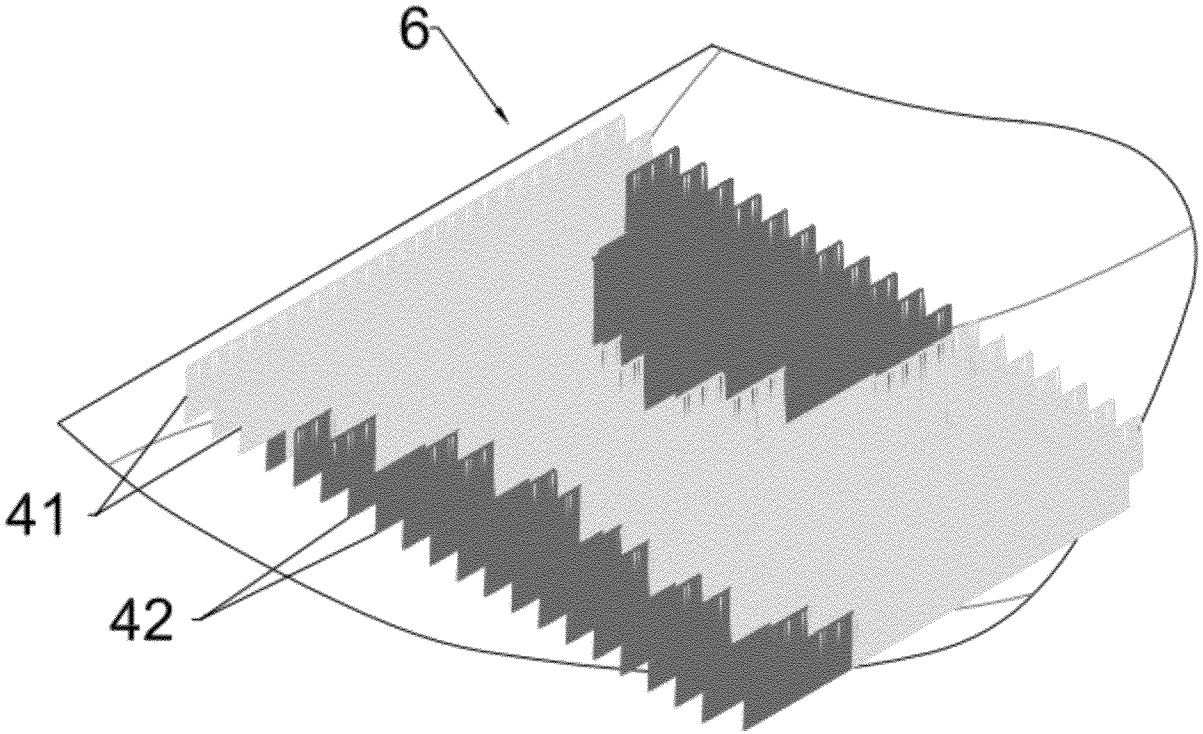
FIG. 9 is a perspective view showing said segment after having subsequently undergone a third pass of said second tufting frame.

After each full revolution of the backing 4, all needle reciprocation and tenter chain rotation is momentarily hatted while the needle carriages 20 laterally shift along their respective tufting frame beams 32 a distance equal to one tufting gage width. This shifting repositions the needles 14 to create anew set of tuft rows, adjacent just-completed rows, once the tenter chains 13 and tufting needles 14 resume their rotating and reciprocating action. Referring back the to the example of the present method, FIGS. 6 & 7 illustrate the creation of a second set of rows along the backing segment 6 during its second pass of the two tufting frames 2, and FIGS. 8 & 9 show the formation of a third row set during its third pass.

In fact, the backing 4 should circulate the tenter frame 5 as many times as is necessary for the needle carriages 20 to have shifted, between successive, complete revolutions of the backing 4, an aggregate distance equal to the lateral spacing between the respective axes of two adjacent needles 14. This enables the needles 14 to create the desired tuft gauge despite the fact that they are laterally spaced greater distance apart. For instance, if all adjacent tufting needles 14 are spaced 4.50 inches along the needle carriages 20 and the stored tufting pattern calls for a tuft gauge of 0.75 inches, then six passes of the backing 4 through the tufting zone—with needles 14 shifting laterally 0.125 inches between each pass—will need to be executed as previously described. Of course, with a machine of higher gantry count, needles 14 along the various tufting frames 2 can be laterally offset, relative to needles 14 along other frames 2, enabling a greater number of tuft rows to be constructed simultaneously and reducing the requisite number of backing 4 revolutions and overall production time.

While the invention has been particularly shown and described as referenced to the embodiments thereof those skilled in the art will understand that the foregoing and other changes in form and detail may be made therein without departing from the spirit and scope of the invention

What is claimed is:

1. A method for tufting yarn into an elongate backing according to a graphic design using a tufting machine comprising a tenter frame and a tufting head, the method comprising:

attaching the length of the backing to the tenter frame such that the backing encircles the tenter frame;

advancing the backing along the tenter frame so that the backing circulates past the tufting head; and inserting yarn tufts into the backing in coordination with its advancement so that tuft rows are formed therealong.

2. A method for tufting yarn into an elongate backing sheet according to a graphic design, the method comprising:

wrapping the backing around an endless conveyor, wherein a portion of the conveyor is disposed within a tufting zone;

rotating the conveyor incrementally so that the backing revolves through the tufting zone; and inserting yarn tufts into the backing in coordination with its incremental movements so that yarn tuft rows are formed therealong.

3. The method of claim 2, wherein said backing encircles said conveyor.

* * * * *